United States Patent [19]

McBee

[11] Patent Number: 4,565,126

[45] Date of Patent: Jan. 21, 1986

[54] TRASH COMPACTOR

[76] Inventor: William D. McBee, 2100 Hayden Bridge Rd., Springfield, Oreg. 97477

[21] Appl. No.: 582,285

[22] Filed: Feb. 22, 1984

[51] Int. Cl.[4] ..... B30B 15/04

[52] U.S. Cl. ..... 100/214; 100/266; 100/269 R; 100/229 A

[58] Field of Search ..... 100/266, 269 R, 214, 100/229 A, 229 R, 902; 92/170, 248, 130 C, 130 B, 132

[56] References Cited

U.S. PATENT DOCUMENTS

| | | | |
|---|---|---|---|
| 811,456 | 1/1906 | Thurston | 100/266 |
| 1,161,883 | 11/1915 | Pope | 100/266 X |
| 1,307,764 | 6/1919 | Sullivan | 100/266 X |
| 2,150,812 | 3/1939 | Aukerman | 100/902 X |
| 2,212,047 | 8/1940 | Ross | 100/902 X |
| 2,375,357 | 5/1945 | Friedman | 100/266 X |
| 2,579,176 | 12/1951 | Dalton | 100/269 R X |
| 2,786,409 | 3/1957 | Claire | 100/266 |
| 3,654,855 | 4/1972 | Longo | 100/229 A |
| 3,685,438 | 8/1972 | Ziegler | 100/229 A |
| 3,763,773 | 10/1973 | Clay | 100/229 A |
| 4,121,512 | 10/1978 | Valdespino | 100/269 R X |

FOREIGN PATENT DOCUMENTS

| | | | |
|---|---|---|---|
| 749181 | 7/1933 | France | 100/266 |

*Primary Examiner*—Billy J. Wilhite

*Attorney, Agent, or Firm*—James D. Givnan, Jr.

[57] ABSTRACT

A trash compactor apparatus including a tubular support structure on which is mounted a cylinder assembly which may be pressurized with water such as from a municipal water system. A piston of the cylinder assembly carries a compaction foot for compressing waste within an open receptacle. Elastic tubing functions to retract the piston in the absence of cylinder pressure. The tubing may be mounted in a detachable manner.

4 Claims, 5 Drawing Figures

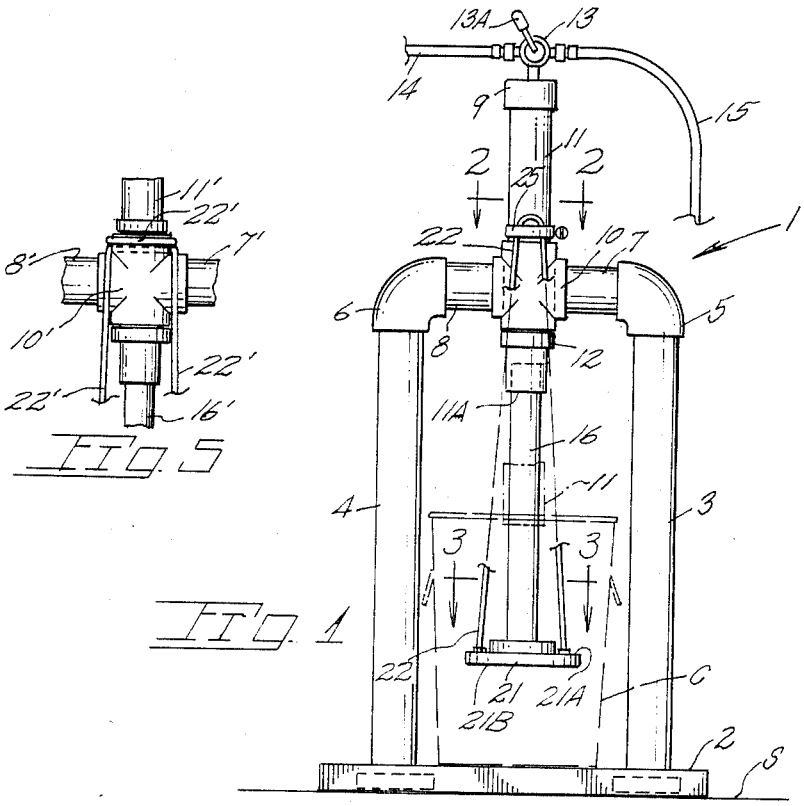
FIG. 1
FIG. 5
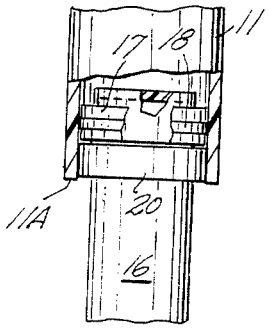
FIG. 4
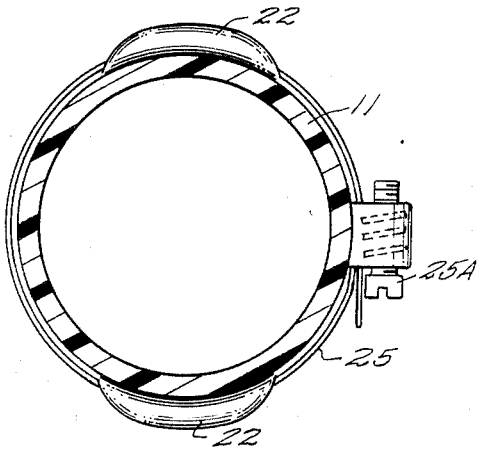
FIG. 2
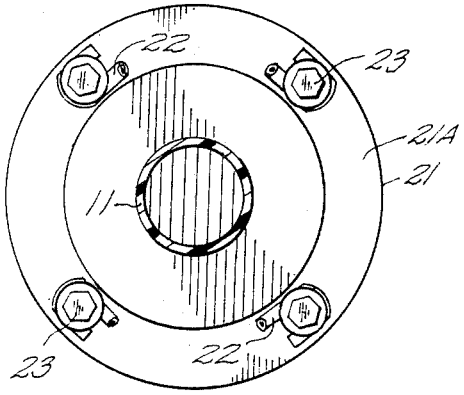
FIG. 3

TRASH COMPACTOR

BACKGROUND OF THE INVENTION

The present invention pertains generally to an apparatus for compacting garbage within a removable container.

Known trash compactors for the home and small business establishments are of complex, costly construction and typically are intended for interior use. In addition to being costly, such compactors oftentimes require structural modification of cabinets and plumbing for their installation.

Known trash compactors for commercial use are not suited, even on a reduced scale, for use in compacting light commercial or household waste which is normally stored in trash or garbage cans. Waste generated by households, restaurants, hotels and other commercial establishments is of a density permitting compaction with water system pressures.

U.S. Pat. No. 4,121,512 discloses a compactor utilizing water system pressure controlled by a three-way valve with a cylinder piston retracted by creating a suction force above the piston. U.S. Pat. Nos. 3,654,855 and 3,763,773 disclose cabinet-housed compactors having bellows retracted by internal and external retraction means. U.S. Pat. Nos. 2,150,812 and 2,212,047 disclose fluid operated can crushing devices with three-way valves thereon. U.S. Pat. No. 3,685,438 discloses a compactor having a fixed head against which a portable refuse container is lifted by a cylinder operated by water system pressure. U.S. Pat. No. 2,579,176 discloses a tobacco press having an air cylinder centrally disposed between a pair of uprights having telescopic sections with a platform therebetween.

SUMMARY OF THE PRESENT INVENTION

The present invention is embodied within an apparatus for compacting trash which utilizes those fluid pressures existing in municipal water systems.

The present apparatus includes a fluid-powered ram supported by a strong lightweight framework. A cylinder assembly includes a manually operated valve to control fluid flows to and from the cylinder. A cylinder piston carries a compaction foot at its lower end and is biased upwardly by resilient piston retraction means. A base of the apparatus rigidly supports upright columns of the apparatus framework.

Important objectives of the present compactor apparatus include the provision of such an apparatus which may utilize municipal water system pressure for a power source enabling avoidance of costly pump components; the provision of a free-standing compactor apparatus utilizing low-cost components resulting in an apparatus having a low manufacturing cost to render same attractive to homeowners and owners of small commercial establishments who heretofore did not find existing trash compactors practical by reason of their high cost and restricted capacity; the provision of a compactor apparatus which permits convenient positioning and removal of standard sized garbage cans from either side of the apparatus.

BRIEF DESCRIPTION OF THE DRAWING

In the accompanying drawing:

FIG. 1 is a front elevational view of the present apparatus;

FIG. 2 is an elevational sectional view taken downwardly along line 2—2 of FIG. 1;

FIG. 3 is an elevational sectional view taken downwardly along line 3—3 of FIG. 1;

FIG. 4 is an elevational view of the lower end of the hydraulic cylinder of the present apparatus with fragments broken away for purposes of illustration; and FIG. 5 is a fragmentary elevational view of the cylinder assembly with the tubing secured in a modified manner.

DETAILED DESCRIPTION OF THE PREFERRED EMBODIMENT

With continuing attention to the drawing wherein applied reference numerals indicate parts hereinafter similarly identified, the reference numeral 1 indicates generally the present apparatus in place on a ground surface S.

A base 2 serves to support upright columns 3 and 4 of a support structure in place and to receive a garbage can C open at its upper end. The column upper ends terminate within elbows 5 and 6 which receive horizontal framework segments 7 and 8. Said segments terminate in an opposed, spaced manner within cylinder mounting means shown as a coupling 10 of a cylinder assembly.

Said assembly includes a cylinder 11 having a lower end 11A disposed adjacent coupling 10 while an end cap is at 9. A collar 12 in place on the cylinder confines the cylinder against upward movement. A three-way valve at 13 includes a control lever 13A which in one position directs a pressurized fluid flow from a conduit pressure source 14 into the cylinder interior while a second control position communicates the cylinder interior with a discharge conduit or drain 15. A piston 16 is equipped at its upper end with a collar 17 with a seal 18 confined within an annular groove in said collar. A stop ring 20 is secured in place within the lower end of the cylinder 11 as by a suitable bonding agent to function as a piston limit stop as shown in FIG. 4. At the piston lower end is a compaction foot 21 having an upper surface 21A to which are secured extensible retraction means 22. Securement may be by bolt and nut assemblies as at 23 with the bolt heads in abutment with the underside 21B of compaction foot 21.

Extensible retraction means 22 are shown embodied within elastomeric surgical tubing which may be conveniently mounted at its upper end by means of a clamp 25 shown in place about cylinder 11. Clamp adjusting means is a treaded member 25A. The upper segments of tubing 22 may be otherwise secured such as, for example, wrapped about coupling 10' per FIG. 5. However, the preferred embodiment is as shown in FIG. 1 which permits clamp 25 to also function to retain cylinder 11 against downward movement. This feature permits cylinder 11, upon clamp removal, to be repositioned downwardly for compact shipping or storage with cylinder 11 located between columns 3 and 4 thereby reducing compactor height. In FIG. 5 the tubing length 22' is shown secured about coupling 10' with other components analogous to those earlier described identified by prime reference numerals.

When the support structure is fabricated from synthetic tubing such as polyvinylchloride pipe, the elbows and coupling members may be in cemented connection with their associated support members. Coupling 10 may be a cross coupling to receive the tubular segments 7 and 8 while receiving the cylinder extending vertically therethrough. Seal 18 has been found satisfactory when embodied in that type of seal known in the trade as a K-seal somewhat resembling in section the letter K. Piston 16 is approximately 0.020 of an inch O.D. less than the inside diameter of cylinder 11.

While I have shown but a few embodiments of the invention it will be apparent to those skilled in the art that the invention may be embodied still otherwise without departing from the spirit and scope of the invention.

Having thus described the invention, what is desired to be secured under a Letters Patent is:

I claim:

1. A free-standing compactor for compacting trash deposited in an upright open waste receptacle, said compactor comprising, a base for placement on a ground surface and on which the receptacle may be placed, a support structure in place on said base, and a cylinder assembly carried by said support structure and including a pressure responsive cylinder having a piston having a compaction member at its external extremity, cylinder mounting means in place on the support structure, valve means for communication with a source of fluid pressure and with the cylinder interior, said valve means including a cylinder exhaust position for venting fluid from the cylinder, elongate elastomeric members located exteriorly of said cylinder and piston and acting on said piston to raise same to a static position in the absence of cylinder pressure, clamping means detachably securing said elongate elastomeric members in place on said cylinder and additionally serving to hold the cylinder in an elevated operable position.

2. A free-standing compactor for compacting trash deposited in an upright open waste receptacle, said compactor comprising, a base for placement on a ground surface and on which the receptacle may be placed, a support structure in place on said base and including tubular segments, and a cylinder assembly carried by said support structure and including a pressure responsive cylinder having a piston having a compaction member at its external extremity, cylinder mounting means comprising a cross coupling in place on the support structure with said cylinder extending through said coupling, said tubular segments in inserted engagement with said cross coupling, valve means for communication with a source of fluid pressure and with the cylinder interior, said valve means including a cylinder exhaust position for venting fluid from the cylinder and extensible retraction means acting on said piston to raise same to a static position in the absence of cylinder pressure.

3. The compactor claimed in claim 2 additionally including clamping means in place on said cylinder and confining same against axial displacement.

4. The compactor claimed in claim 3 wherein said extensible retraction means are elongate elastomeric members, said clamping means detachably securing said elastomeric members to said cylinder.

* * * * *